US006779687B2

(12) United States Patent
Vallier et al.

(10) Patent No.: US 6,779,687 B2
(45) Date of Patent: Aug. 24, 2004

(54) SQUEEZABLE JUICE DISPENSER FOR BEVERAGES

(76) Inventors: Lisa Vallier, 75 Revere St., Marshfield, MA (US) 02050; Kathleen Colbert, 20 Rockland House Rd., #304, Hull, MA (US) 02045

( * ) Notice: Subject to any disclaimer, the term of this patent is extended or adjusted under 35 U.S.C. 154(b) by 0 days.

(21) Appl. No.: 10/219,786

(22) Filed: Aug. 16, 2002

(65) Prior Publication Data

US 2004/0031817 A1 Feb. 19, 2004

(51) Int. Cl.[7] ..... B67D 3/18

(52) U.S. Cl. ..... 222/78; 222/94; 222/541.1; 222/541.9; 222/213

(58) Field of Search ..... 222/94, 105, 107, 222/185.1, 541.1, 212, 213, 215, 78, 153.07, 541.9; 383/38, 41, 211; 100/131, 132, 133, 134, 135; 426/115; 206/219, 221, 222; 99/495

(56) References Cited

U.S. PATENT DOCUMENTS 2,517,027 A * 8/1950 Rado ..... 222/94
2,648,463 A * 8/1953 Scherer ..... 222/107
2,789,496 A * 4/1957 Turner ..... 100/211
RE24,621 E * 3/1959 Schares ..... 99/171
3,027,826 A * 4/1962 Morris ..... 100/133
3,126,821 A * 3/1964 Schlidt et al. ..... 100/133
3,189,227 A * 6/1965 Hobbs et al. ..... 222/94
3,567,074 A * 3/1971 Brown ..... 222/107
3,754,502 A * 8/1973 Kaufman ..... 100/133
3,917,116 A * 11/1975 Mason ..... 222/92
4,789,082 A * 12/1988 Sampson ..... 222/1
5,241,150 A * 8/1993 Garvey et al. ..... 219/725
5,373,966 A * 12/1994 O'Reilly et al. ..... 222/94
5,494,192 A * 2/1996 Redmond ..... 222/107
5,605,710 A * 2/1997 Pridonoff et al. ..... 426/86
5,706,721 A * 1/1998 Homes ..... 99/495
5,919,501 A * 7/1999 Rozzano ..... 426/87
5,996,845 A * 12/1999 Chan ..... 222/107
6,244,466 B1 * 6/2001 Naslund ..... 222/94

* cited by examiner

*Primary Examiner*—Frederick C. Nicolas
(74) *Attorney, Agent, or Firm*—John M. Brandt

(57) ABSTRACT

A juice dispenser adapted to be used for adding flavoring to individual beverage servings in a glass or a cup consisting of a substantially flat hollow squeezable flexible container having dispensing ports along one edge thereof and a removable seal for holding the juice within the container.

4 Claims, 1 Drawing Sheet

SQUEEZABLE JUICE DISPENSER FOR BEVERAGES

BACKGROUND OF THE INVENTION

1. Field of the Invention

The invention resides in the field of liquid dispensers and more particularly relates to squeezable juice dispensers for flavoring individual beverage servings or drinks.

2. Description of the Prior Art

Squeezable juice dispensers are known in the prior art. In particular, flexible dispensers in the shape of a lime or lemon having a nozzle and cap at the top are in general household use. These designs are intended to be used a number of times until the contents are exhausted. Due to their size and cost as well as for sanitary reasons, they are not suitable for use in situations where individual beverages are served in a controlled or limited environment, airplane flights for example.

Recent airline restrictions on utensils sharp enough to cut a real lemon, lime, or similar fruit to accompany the serving of individual drinks to passengers in flight require an alternative approach to continue that part of the service. The present invention is intended to provide a means whereby individual servings of such juices may be supplied for optional use by an airplane passenger or any other individual user such as customers in bars and restaurants, spectators at sporting events, picnics, outings, parties and the like.

SUMMARY OF THE INVENTION

The invention may be summarized as a juice dispenser for individual beverage servings comprising a flat squeezable hollow container with dispensing ports along one edge and a removable sealing means such as a pull tape for securing the juice within the dispenser until the time of use. The dispenser may be formed, colored, and textured to simulate a fruit slice of the type of juice contained therein. Additionally, the juice containing chamber may be divided to provide for placing the dispenser over the edge of a glass such that it will be retained in place by the pressure of the opposing sides of the split. Filling can be accomplished through one or more of the dispenser's ports.

A particular advantage of the flat configuration of the invention is the security of the device on a moving vehicle such as an airplane. The flat structure will prevent the dispenser from rolling off a serving tray in the event of lurches from airpockets or course changes.

These and other features and advantages of the invention will become more apparent from the description of the preferred embodiment and drawings which follows.

DESCRIPTION OF THE PREFERRED EMBODIMENT

Figure 1:
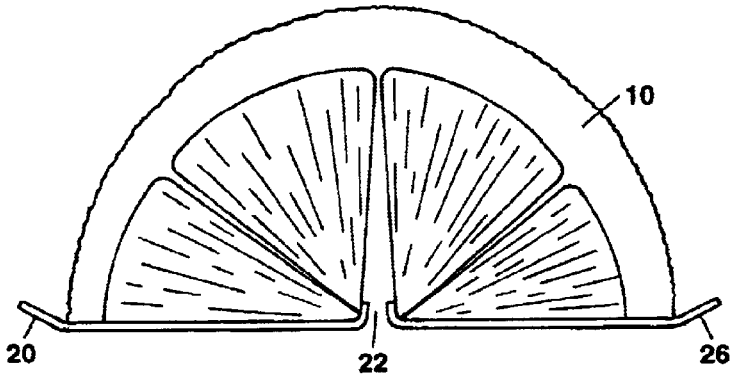
FIG. 1 is a plan view of the preferred embodiment of the invention.
Figure 2:
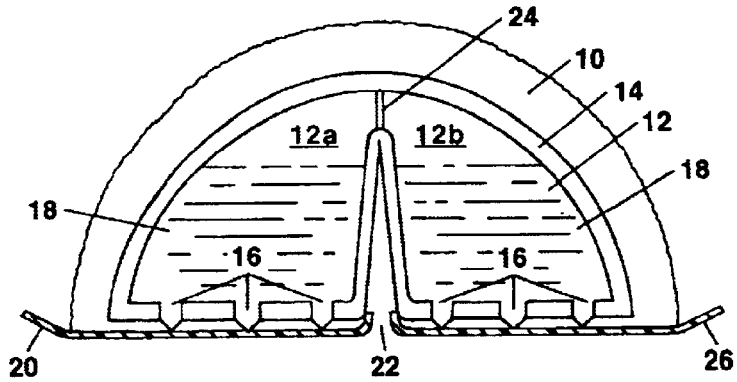
FIG. 2 is a cross-sectional view of the embodiment of FIG. 1.

Referring first to FIG. 1, there is shown a plan view of the preferred embodiment of the invention wherein vessel 10 may have the outward appearance, texture, and coloring of a slice of fruit, a lemon or lime for example. The vessel is hollow, flexible and squeezable and, as shown in cross-sectional illustration FIG. 2, has at least one inner juice containing chamber 12 which may be integral with the walls of vessel 10 or for purposes of manufacture a separate unit 14 as indicated.

Connecting with chamber 12 are one or more ports 16 which may be simple holes or passageways or may comprise tapered nozzles as shown. A quantity of juice 18 disposed in chamber 12 is held within the chamber by removable sealing means 20, a strip of adhesive tape for example. Vessel 10 may be partially separated from edge to edge to create slot 22 providing a means by which the dispenser may be held in place over the edge of a beverage container such as a glass for decorative effect or for further use on the same or an additional beverage. Such a slot divides chamber 12 substantially into two parts or sub-chambers 12*a* and 12*b* which division may be completed internally by wall 24. A separate second sealing means 26 would then be used to allow juice to be expelled from only one chamber, 12*a* or 12*b*, at a time. This arrangement would allow a double serving of the same juice or two separately flavored juices in the same container.

Figure 3:
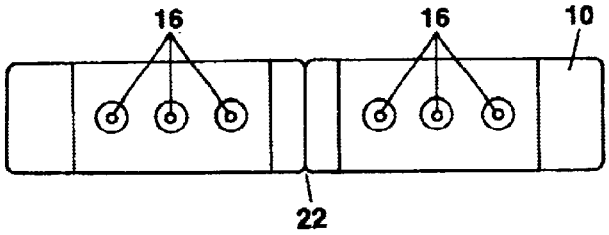
FIG. 3 is a bottom view of the embodiment of FIG. 1.
Figure 4:
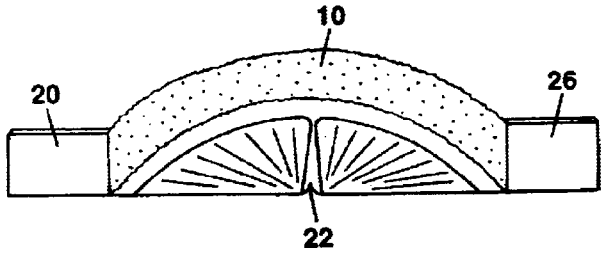
FIG. 4 is a top perspective view of the embodiment of FIG. 1.

FIG. 3 illustrates the bottom of vessel 10 with sealing means 20 and 26 removed while FIG. 4 shows a perspective top view of the invention.

What is claimed is:

1. A juice dispenser for individual drinks comprising in combination:

A. a flat hollow vessel having at least one chamber for containing said juice, said vessel having flexible squeezable sides, said sides of said dispenser being partially separated to provide a slot whereby said dispenser can be placed and secured over the edge of a beverage container, said vessel having at least one port disposed in an edge thereof and communicating with said chamber for dispensing said juice upon squeezing said sides; and B. removable sealing means for sealing said port and preventing the flow of said juice through said port until said sealing means is removed.

2. The apparatus of claim 1 wherein said removable sealing means comprises an adhesive tape disposed on said edge.

3. The apparatus of claim 1 wherein said vessel is semi-circular in profile.

4. The apparatus of claim 1 wherein said chamber is separated into at least two adjacent chambers for selectively dispensing a portion of said juice, each of said chambers having a separate removable sealing means associated therewith.

* * * * *